United States Patent [19]

Lichter

[11] Patent Number: 4,712,490

[45] Date of Patent: Dec. 15, 1987

[54] SAFE

[76] Inventor: Robert J. Lichter, 15571 Placid Cir., Huntington Beach, Calif. 92647

[21] Appl. No.: 833,889

[22] Filed: Feb. 27, 1986

[51] Int. Cl.[4] ..... E05G 1/00

[52] U.S. Cl. ..... 109/69; 109/73

[58] Field of Search ..... 109/69, 73, 78, 80, 109/59 R; 99/465; 52/20, 21

[56] References Cited

U.S. PATENT DOCUMENTS

| | | | |
|---|---|---|---|
| 67,045 | 7/1867 | Hall | 109/74 |
| 465,510 | 12/1891 | Yale | 109/69 |
| 3,481,288 | 12/1969 | Teleky | 109/58 |
| 3,715,998 | 2/1973 | Teleky | 109/58 |
| 3,908,730 | 9/1975 | Goss, Jr. et al. | 49/405 |
| 4,070,074 | 1/1978 | Rohme | 109/70 |
| 4,136,792 | 1/1979 | Wilson | 403/353 |
| 4,176,440 | 12/1979 | Lichter | 109/80 |
| 4,294,040 | 10/1981 | Crotti | 49/254 |
| 4,408,545 | 10/1983 | Lichter | 109/80 |

*Primary Examiner*—Carl D. Friedman
*Assistant Examiner*—Caroline D. Dennison
*Attorney, Agent, or Firm*—Gausewitz, Carr & Rothenberg

[57] ABSTRACT

A safe having a valuables chamber with an access opening with inwardly extending ledges for placement of a plate-shaped separate steel door thereon, and a set of grooves formed on opposing walls retaining the door therein, the width of the grooves being a distance slightly more than the thickness of the door, with one groove being substantially greater than the depth of the other, with one edge of the door being inserted on a slight angle into the deeper groove while the other edge is pivoted toward the ledge, the door then being laterally displaced until the latter edge is in abutment with the seat of the shallower groove. A lock assembly on the reverse side of the door has the latch bolt engaging a detent in a metal bar for prevention of lateral movement with reinforcing bolts adjacent the lock bolt preventing force on the lock mechanism in the event of forceful intrusion attempts. In one embodiment, the grooves are formed by elongate bar members, while in another embodiment, the grooves are formed within the walls themselves.

24 Claims, 7 Drawing Figures

60
61
56
58
59
40
53
52
54
53
10
22
14
16
44
25
23
20
46
34
44b
46a
24
48b
28
32
50
30
48
42a
42
48a
42b
18
12

FIG. 2.
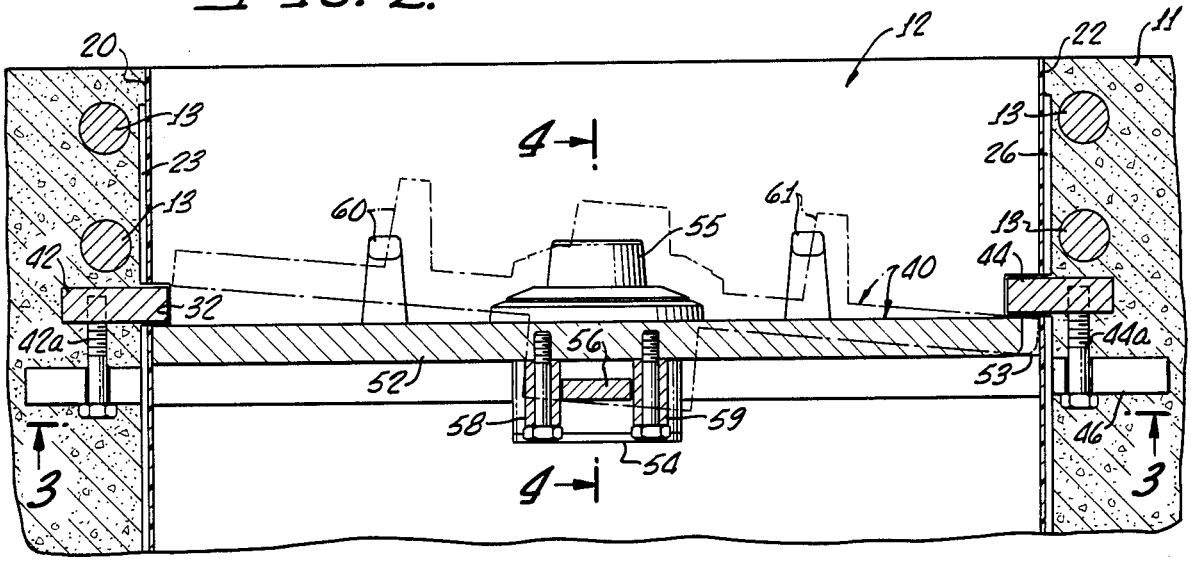
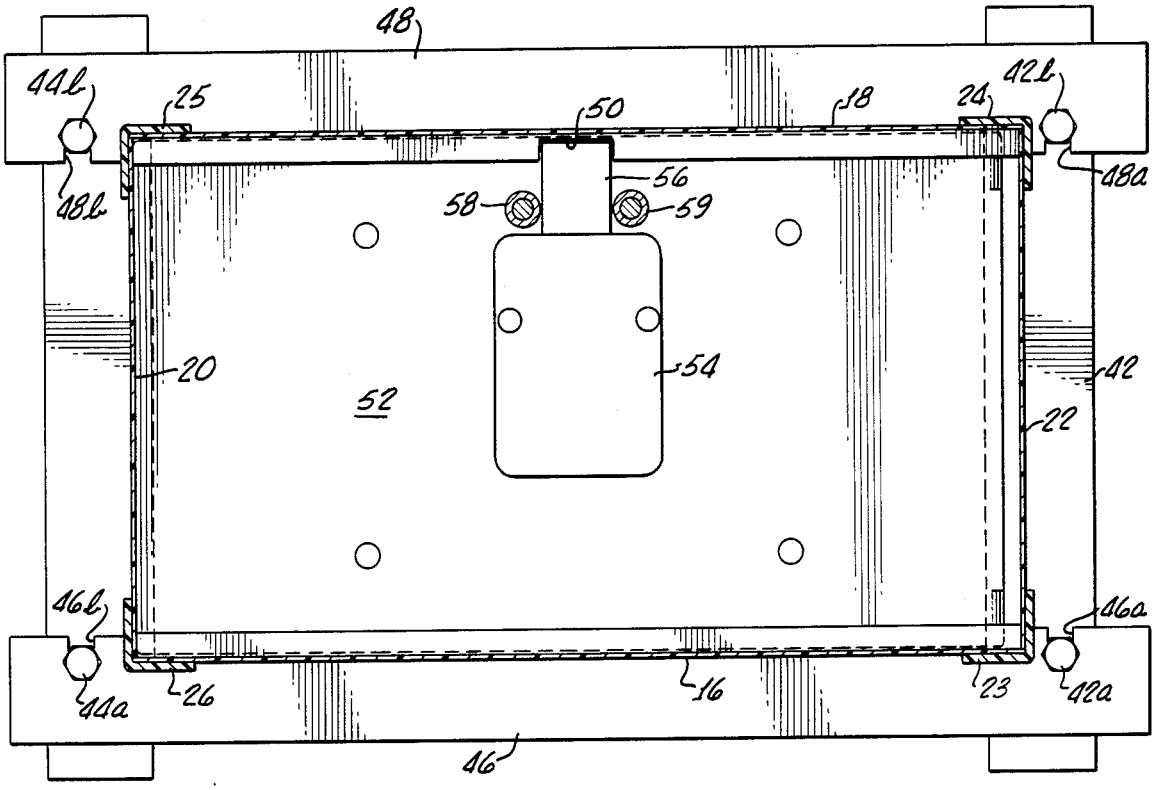
FIG. 3.
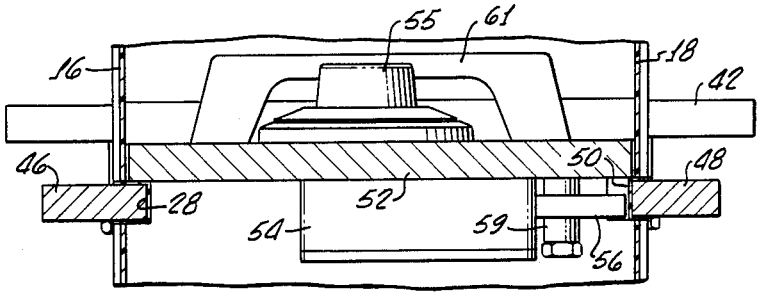
FIG. 4.

SAFE

BACKGROUND OF THE INVENTION

The background of the invention will be discussed in two parts:

1. Field of the Invention

This invention relates to the field of safes adapted to contain valuable papers and articles.

2. Description of the Prior Art

There are numerous prior art wall and floor safes adapted to be embedded in concrete, etc. or adapted to be free-standing. The variations, and complexities in such safe structures have a direct impact on the cost of construction, and ultimately, the cost of such safes. Many of such safes are intended for residential use, and may be installed in a wall or in a floor of the residence, and, in the latter instance such safes are normally embedded in concrete.

One such early structure is shown and described in U.S. Pat. No. 67,045 issued July 23, 1867, to Hall for a "Burglar-Proof Safe" in which a stepped laminated door structure fits within a correspondingly formed door opening.

Another such structure is shown and described in U.S. Pat. No. 3,481,288, entitled "Wall Safe", issued to Teleky on Dec. 2, 1969, the safe including a permanently installed container with lateral vertically arranged recesses configured for receiving a separate door portion by lateral insertion into the recesses.

U.S. Pat. No. 3,715,998, is directed to another such safe structure, and is entitled "Wall Safe", such patent being issued to Teleky on Feb. 13, 1973, the structure having a door which is substantially rectangular and when it is in the closed position the margins of the door substantially throughout their entire length are overlapped by recesses along the margins of the opening that is closed by the door.

U.S. Pat. No. 4,070,074, entitled "TamperProof Cabinet", issued to Rohme, on Jan. 24, 1978, such patent disclosing cabinet having a door which is required to be unlatched by an initial unlatching sliding movement and then the usual pivotal traverse from its closed into its open position.

Another safe structure is shown and described in U.S. Pat. No. 4,176,440, issued to Robert J. Lichter, the applicant herein, on Dec. 4, 1979, such patent being entitled "Safe, and Method and Apparatus for Building It", the safe being a "do it yourself" safe having a liner with various grooves or slots adapted to receive the inner edge portions of steel bars of predetermined size, a bottom, a firecap mold, and a strong steel door with associated lock. The parts are assembled in an appropriate location within the residence, and then the concrete is poured, and the balance of the parts attached.

A building door is shown in U.S. Pat. No. 4,294,040, entitled "Safety Door for Buildings and Rooms", issued Jan. 8, 1957, to Crotti, the patent disclosing a safety door structure which is transveresly sliding with one part thereof serving as a supporting column equipped with hinges and the other serving as a door panel rotatably supported by the hinges, the supporting column disappearing from view during the opening stage with the opposite side of the door, including the lock, disappearing from view upon closing with the lock accessible through an access opening.

U.S. Pat. No. 4,136, 792, was issued to Wilson, on Jan. 30, 1979, and is entitled "Quick Attachment Device for a Lifting Tractor", this patent being included to illustrate closure release mechanisms, and discloses an implement, such as a bucket, for attachment to and removal from, a highlift or tractor.

It is an object of the present invention to provide a new and improved safe and door structure.

It is another object of the present invention to provide a new and improved readily assembled, low cost door and safe structure.

SUMMARY OF THE INVENTION

The foregoing and other objects are accomplished by providing a safe having a valuables receiving chamber with a generally rectangular opening with a first set of inwardly extending ledges on opposing walls for placement of a plateshaped separate steel door thereon, and a set of grooves formed on the opposite walls transverse to the first set of opposing walls providing stops for retaining the door therein, the width of the grooves being a distance slightly more than the thickness of the door, with one groove having a depth substantially greater than the other, with one edge of the door being inserted on a slight angle into the deeper groove while the other edge is pivoted toward the ledge, the door then being laterally displaced until the latter edge is in abutment with the seat of the shallower groove. A lock assembly on the reverse side of the door has the latch bolt engaging a detent in one bar for prevention of lateral movement with reinforcing bolts on both sides of the lock bolt preventing transmission of force to the lock mechanism in the event of forceful intrusion attempts. In one embodiment, the grooves are formed by elongate bar members, while in another embodiment, the grooves are formed within the walls themselves.

Other objects, features and advantages of the invention will become apparent from a reading of the specification, when taken in conjunction with the drawings, in which like reference numerals refer to like elements in the several views.

BRIEF DESCRIPTION OF THE DRAWINGS

FIG. 2 is a side elevational view, partially in cross-section and partially broken away of the safe apparatus of FIG. 1 illustrating the door engagement;

FIG. 3 is a bottom plan view of the apparatus of FIG. 2, as viewed generally along line 2—2 thereof;

FIG. 4 is a side elevational view of a portion of the structure of FIG. 2, partially in cross-section, as viewed generally along line 4–4 thereof;

DESCRIPTION OF THE PREFERRED EMBODIMENT

The safe construction to be hereinafter described is a floor safe and may be formed utilizing the construction heretofore described in applicant's U.S. Pat. No. 4,176,440, which is herein hereby incorporated by reference. The construction in such patent is an in place construction wherein a liner, preferably formed of an appropriate plastic material, is employed as a combination liner and form for the pouring of concrete thereabout to provide the majority of the body of the floor safe.

Figure 1:
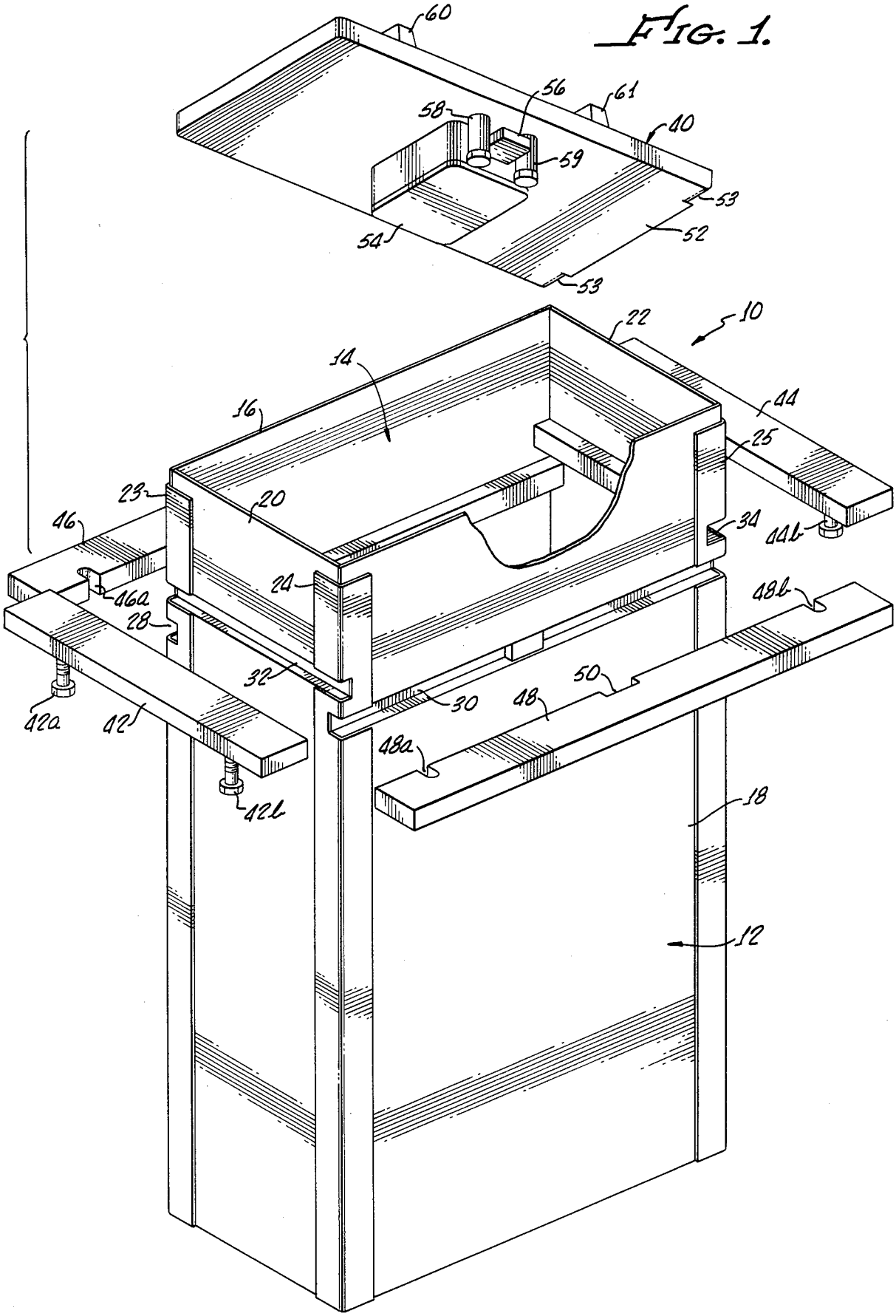
FIG. 1 is an exploded perspective view of the components of the safe apparatus in accordance with the present invention.

Referring now to the drawings, and particularly to FIG. 1, there is shown in exploded perspective view a safe, generally designated 10, having a somewhat elongate generally rectangular (in plan view) liner 12 forming a valuables chamber 14. The liner 12 is formed of a first set of opposing side walls 16 and 18, and an interconnecting set of mutually perpendicular opposing end walls 20 and 22. The corners thereof are suitably reinforced as with corner brackets 23–26, which may be integrally formed with the side walls or may be angle iron or the like, depending on the method of fabrication of the liner 12. Such a liner may be made for example by injection molded plastics techniques, or may be fabricated from sheet metal or sheet steel of sufficient thickness suitably connected such as by welding. Liner 12 may also be formed of a thermosetting resin or other fire-resistant and heat insulating substance. By reference also to FIG. 2, in accordance with the teachings of applicant's above-mentioned U.S. Pat. No. 4,176,440, after assembly and pouring, the concrete 11 and reinforcing bars or rebars 13 surround the liner 12 and other parts of the safe. It is also to be understood that the invention described herein is equally applicable to a safe which is formed of all metal, such as by steel fabrication or steel casting methods, and as such the invention is not intended to be limited to a cast in place concrete construction.

The upper edges of the walls 16, 18, 20 and 22 define a common plane. Spaced downwardly from this common plane, and extending inwardly from the side walls 16 and 18 are integrally formed laterally extending grooves 28 and 30, both of which are at a predetermined distance from, and parallel to, the upper edges of the container opening 14. Similarly, the end walls 20 and 22 have integrally formed therein opposing laterally extending grooves 32 and 34, each being at the same distance from, and generally parallel to, the upper edges of the walls 20 and 22, but spaced closer thereto than the grooves 28 and 30. The distance between the lower edge of the grooves 32 and 34 and the upper edges of the grooves 28 and 30 form door receiving grooves of a width slightly greater than the thickness of the coacting edges of the door, generally designated 40.

The grooves 32 and 34 on the end walls 20 and 22 are configured and dimensioned for receiving therein the edges of bar members 42 and 44, respectively, such bar members preferably being formed of a steel composition, such as case-hardened steel. Similarly, the grooves 28 and 30 in the side walls 16 and 18 are configured and dimensioned for receiving therein the edges of bar members 46 and 48, respectively, such bars, likewise being formed of suitable steel material, and having a generally rectangular cross-sectional configuration. To facilitate assembly, the grooves 28, 30, 32 and 34 are formed to enable them to receive the bars therein in a relatively light press fit relationship, such that after placement of the corresponding bar therein, there will be no danger of slippage.

The bar members 42 and 44 are generally identically configured and are of a generally rectangular elongate configuration, having a length greater than the corresponding dimension of the grooves 32 and 34, respectively, that is, each bar member 42 and 44 is longer than the width of the end walls 20 and 22. Similarly, the bar members 46 and 48 have a length greater than the width of the side walls 16 and 18, respectively.

The dimensions and configurations of the bar members 42, 44, 46 and 48 enable coupling of the bar members together in spaced relation upon assembly, after insertion into the grooves 28, 30, 32 and 34. For this purpose bar members 46 and 48 have formed in the leading edges thereof, cutouts **46*a*, 46*b*, 48*a* and 48*b*, respectively, for receiving therein bolt members 42*a*, 44*a*, 42*b*, and 44*b*, respectively, depending from the bar members 42 and 44, respectively. As shown in FIG. 2, the bolt members may be attached by drilling and tapping holes in the upper bar members 42 and 44, and threadably engaging these holes with the bolt members 42*a*, 42*b*, 44*a* and 44*b*, with final tightening accomplished upon assembly. With the respective bar members in the respective grooves, the bolt members engage the cutouts (See FIG. 2). For example, bolt member 42*b* of bar member 42 engages cutout 48*a* of bar member 48, while bolt member 44*b* engages cutout 48*b*. Similarly, bolt member 42*a* of bar member 42 engages cutout 46*a* of bar member 46, while bolt member 44*a* of bar member 44 engages cutout 46*b* of bar member 46 (See FIG. 2**). This engagement retains the bar members in spaced generally parallel relation after assembly.

As shown in FIGS. 1 and 3, the groove 30 and the bar member 48 are provided with coacting indentations which form a lockbolt receiving notch 50 disposed generally centrally relative to the width of the sidewall 18. The door 40 is formed of a generally rectangular steel plate member 52 having a lower edge 53 thereof rounded for reasons which will be hereafter discussed. Located relatively centrally on, and extending therough the plate member 52 is a lockset 54, which includes a combination dial 55 accessible from the exterior of the door 40. The lockset 54 is secured to the bottom or interior of plate member 52 such as by bolts and includes a slidable lockbolt 56, which is movable from a position within the housing of the lockset 54 to an extended position, shown in FIG. 3 into engagement with the notch 50. Lockbolt reinforcing means are provided, such means including safety bolts 58 and 59 secured to the undersurface of the plate member 52 in generally perpendicular relation thereto, such bolts 58, 59 being positioned in spaced relation on either side of the lockbolt 56. The purpose of these bolts is to reinforce the door assembly 40 against lateral movement in the event an intruder attempts to pry the door laterally as viewed in FIG. 3. As shown in FIG. 1, the door 40 preferably includes a pair of handles 60, 61 secured to the exterior of the plate member 52 for facilitating lifting and removal of the door 40. The handles 60 and 61 are secured with fasteners in such a way that excessive force, such as by applying a lever to force the door 40 will result in breakage of the fasteners.

Referring now to FIGS. 2 through 4, the relationship of the bar members 42, 44, 46, and 48 to the door 40 will be described. The door 40 is dimensioned for being received in and completely removed from the open upper end of the chamber 14. For this purpose, the plate member 52 is generally rectangularly configured, or square, in plan elevation with the width thereof closely approximating the width of the chamber 14.

The length of the plate member 52 of the door 40 is dimensioned to provide clearance while inserting at an angle as shown in dotted lines in FIG. 2, with the rounded lower edge 53 positioned in the groove formed beneath the intruding inner edge of groove 34 which is reinforced with bar member 42. It is to be emphasized that the inner edge of groove 34 intrudes into the chamber 14 a distance substantially greater than that of the intrusion of the inner edge of groove, 32, with the length of the plate member 52 being equal to the distance between these inner edges plus the intruding length of the inner edge of groove 34, with a slight variance allowing for tolerances. The distance of intrusion of groove 34 may be one and one-half times, and preferably twice the distance of intrusion of groove 32. When discussing the operation of the door 40 herein, it is to be understood that reference to the bar members includes the corresponding groove in which the bar member is positioned, with the bar members being the primary structural components for attachment of the door 40.

In this manner for closing the safe 10, the door 40 is positioned at the angle as shown in FIG. 2 with the rounded lower edge of plate member 52 resting on the lengthwise extending bar members 46 and 48. A slight force is exerted laterally until this first edge is abutting against the sidewall 22 during which time the door 40 is being lowered along the opposite edge until this opposite edge clears the upper corner of the inner edge of groove 32. Thereafter the door 40 is permitted to drop until totally supported by the longitudinally extending ledges formed by bar members 46 and 48. The door 40 is then shifted laterally in the opposite direction into the groove 32 formed between bar 42 and lower stop ledge bar members 46 and 48, until the opposite edge of plate member 52 is seated in the groove in abutting relation with the opposite sidewall 20, as shown in solid lines in FIGS. 2 and 3, the sidewall 20 being the bottom or the seat of the door receiving groove so-formed. At this position, the lockbolt 56 is in alignment with the notch 50 and the combination 55 may be spun to lock the door 40 between the bar members 42 and 44.

With this configuration of the plate member 52 relative to the upper retaining bar members 42 and 44, along with the notch 50 and the safety bolts 58 and 59, an efficient, yet simple arrangement is provided for secure locking. In the event an intruder attempts to pry the door 40 by placing a pry bar between the inner edges of either groove 32 or 34, the side forces exerted will place the lockbolt 56 in shear relative to the notch 50. The safety bolts 58 and 59 disposed in proximate relation to the inner edge of bar member 48 assures that these force are localized and concentrated on the lockbolt 56 only, and are not transmitted to the locking mechanism of the lockset 54, thus protecting the lockset 54 from damage by prying.

Figure 5:
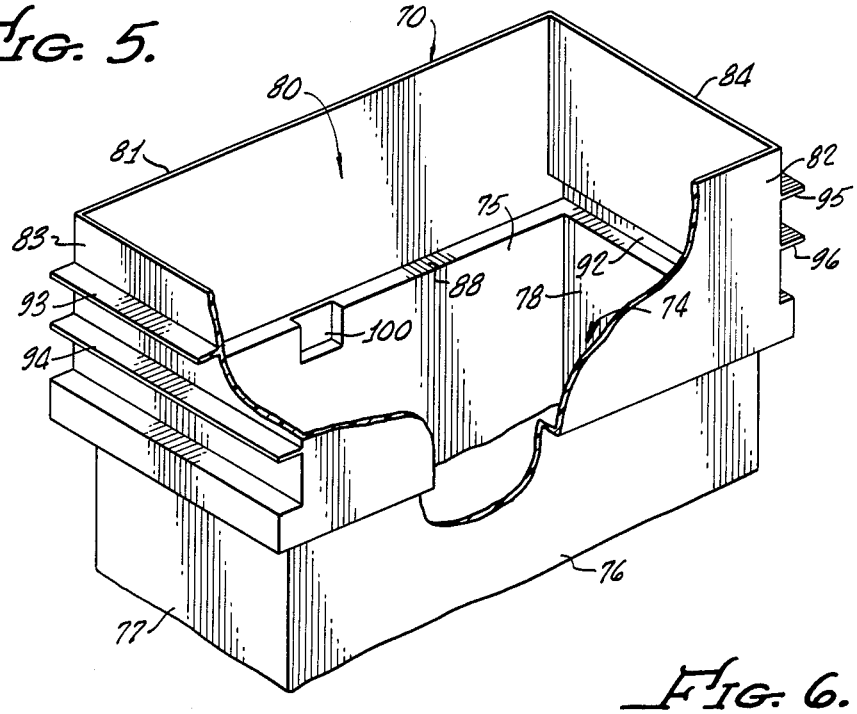
FIG. 5 is a perspective view of an alternate embodiment of the safe apparatus according to the invention.
Figure 6:
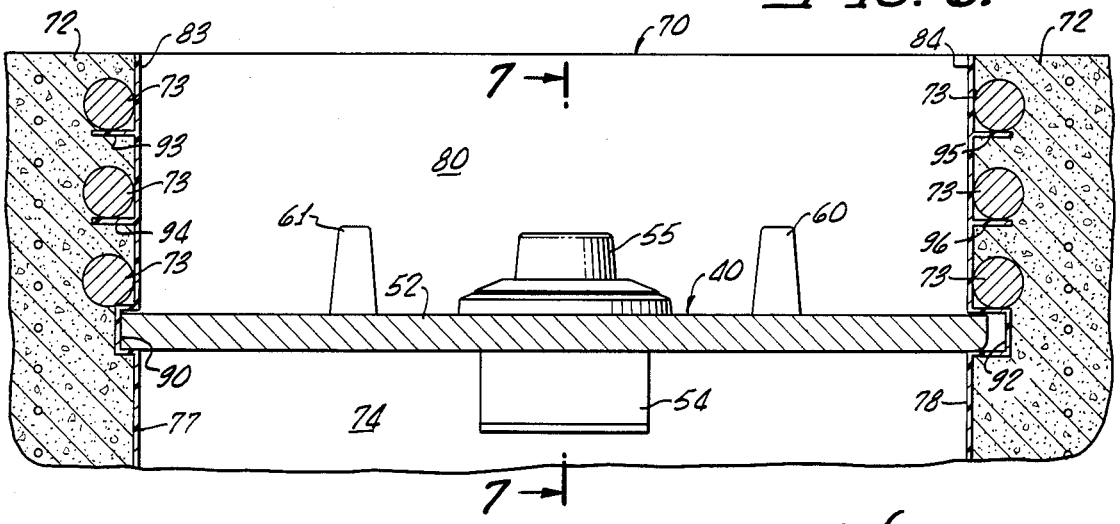
FIG. 6 is a side elevational view of the embodiment of FIG. 5, partially broken away and partially in cross-section, illustrating the door engagement therewith.
Figure 7:
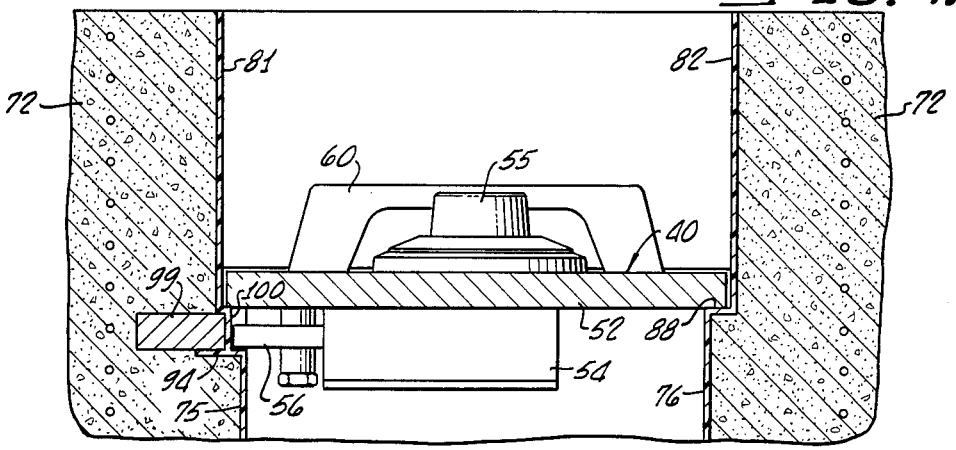
FIG. 7 is a cross-sectional view of the apparatus of FIG. 6 as viewed generally along line 7—7 thereof.

FIGS. 5 through 7 depict a modified liner 70 which is more economical in that a number of bar members are eliminated with structural integrity being accomplished by means of the concrete 72 and judicious placement of rebars 73. The door 40 is identical to that previously described. However, the liner 70 is formed with a lower portion 74 defined by sidewalls 75 and 76, and end walls 77 and 78, and an upper portion 80 being defined by sidewalls 81 and 82 and end walls 83 and 84, the lower portion 74 being the rectangularly configured valuables receiving chamber of smaller cross-section to define a peripheral door receiving ledge 88, with this ledge 88 being the dividing line between the lower and upper portions 74 and 76, respectively. The door 40,as shown in FIGS. 6 and 7 rests on this ledge 88.

Immediately above this ledge laterally opposing grooves 90 and 92 are formed for receiving the opposite ends of the plate member 52 of the door 40 (See FIG. 6). The grooves 90 and 92 of this embodiment are the equivalent of the door receiving groove means formed in the preceding embodiment between bar members and, as in the preceding embodiment, the grooves are dimensioned so that the depth of one groove 92 is substantially greater than the depth of groove 90, as stated above.

The exterior of the liner 70 is provided on the end walls 83 and 84 of the upper portion 80 with outwardly extending flanges or fins 93 and 94 on end wall 83 and fins 95 and 96 on end wall 84. Each of the fins extends generally perpendicular to the corresponding end wall a distance sufficient to cooperate with a rebar 73 postioned thereon prior to pouring of the concrete (See FIG. 6). In additon rebars 73 are positioned on the exterior of the end wall grooves 90 and 92. The rebars 73 and concrete 72 provide structural integrity for the liner 70.

However, to assure integrity in the locking arrangement, a lock notch 100 is formed in the sidewall 75 of the lower portion 74 of the liner 70 and a longitudinal fin 94 is formed on the exterior of sidewall 75 in alignment with the lower edge of notch 100. An elongate bar member 99 having a notch for mating with the lock notch 100 is positioned on this fin 94 to provide shear strength at the locking location, that is where lockbolt 56 engages notch 100.

Insertion and removal of door 40 is accomplished in the same manner as that previously described, with the door 40, in its locked position being depicted in FIGS. 6 and 7. In this embodiment, the liner 70 is lowered into position within a hole in the ground and then leveled. The bar member 99 is positioned on fin 94, and the rebars 73 are positioned in resting relation on each of the fins 93–96,as well as on the exterior of the ledge formed by grooves 90 and 92. The rebar 73 and bar member 99 are suitably secured, such as by wire, to prevent movement during pouring of the concrete 72. After curing of the concrete, the concrete 72, the bar member 99 and the rebar 73 provide the required strength for the safe construction, while the grove and notch arrangement along with the safety bolts 58 and 59 protect the lock mechanism 54 from damage in the event one attempts to pry the door 40. With the lockbolt 56 operable in a direction transverse to the direction of insertion of the door, the strength of the safe is greatly increased to protect against shear.

In accordance with the safe construction hereinabove described, there is a simple, yet effective door and safe construction, which may be equally applicable to a basic steel safe preassembled at the factory. While there has been shown and described a preferred embodiment, it is to be understood that various other adaptations and modifications may be made within the spirit and scope of the invention. For example, although the door is depicted as being formed of a plate member 52 of generally uniform thickness, it is only necessary that the groove contacting edges be of a thickness consisitent for being received within the appropriate groove. Furthermore, the lower ledges supporting the door 40 need not be continuous surfaces, but may be, for example, pins or rods projecting into the opening. In addition, the safety bolts 58 and 59 may be replaced by steel blocks or the like in close relation to the lockbolt 56 for performing the same function. Furthermore, although the safety bolts 58 and 59 provide a margin of protection, such parts may be eliminated since, in any event, the lockbolt 56 is formed of a high strength steel material which has much greater strength in shear than in compression. A firecap such as shown in applicant's above-mentioned patent may likewise be affixed to the upper open end of the safe structure herein. Furthermore, it is to be understood that the term rectangular, equally includes a square configuration of the door plate member 52. Other such variations will be readily apparent to those skilled in the art, and it is intended that the invention be limited only to the scope of the appended claims.

I claim:

1. In a safe apparatus, the combination comprising:

wall means defining a generally rectangular chamber for receiving valuables therein through an access opening thereof;

ledge means on said wall means extending partially into said chamber;

lockbolt receiving means on one of said wall means generally centrally relative thereto;

first and second groove means on oppositely disposed ones of said wall means in transverse relation to said one wall means with said lockbolt receiving means, said first groove means having a depth at least twice the depth of said second groove means;

separate door means for closing said opening, said door means including at least a first and second opposing edge portions having a thickness sufficient for being received within said groove and having a first dimension in the direction between said groove means generally equal to the distance between the innermost ends of said groove means plus a distance generally equal to the depth of said first groove means, and a second dimension orthogonal to said first dimension generally equal to the spacing between the wall means in that direction, said door means being inserted by positioning at an angle with said first edge thereof on said ledge means and then sliding said edge into said first groove means while pivoting said second edge thereof toward said ledge means; and lock means on said door mean including a lockbolt actuable from a first unlocked position into a second locked position in engagement with said lockbolt receiving means only with said door means in abutting relation with the bottom of said second groove means.

2. The combination according to claim 1 wherein said safe apparatus includes a liner, said wall means are walls of said liner and said groove means are at least partially formed in said liner.

3. The combination according to claim 2 wherein said liner includes means on opposing walls of said wall means thereof for receiving on the exterior thereof a first set of opposing bar members for at least partially forming said ledge means, and means on the other opposing walls of said wall means thereof for receiving on the exterior thereof a second set of bar members in spaced relation to said first set of bar members for at least partially forming said groove means.

4. The combination according to claim 2 wherein said ledge means are at least partially formed in said liner.

5. The combination according to claim 1 wherein said lockbolt receiving means is a notch configured for receiving the free end of said lockbolt therein, and said door means are provided with reinforcing means at a position on each side of said lockbolt in its locked position whereby to preclude forces from forcible entry from being transmitted to said lock means.

6. The combination according to claim 5 wherein said lockbolt receiving means includes a notch in a metal bar in fixed relation to said wall means.

7. In a floor safe construction for onsite assembly accompanied by the pouring of concrete thereabout, the combination comprising:

a liner having a first set of opposing walls and a second set of mutually perpendicular walls defining, at least in part, a valuables receiving chamber with an access opening thereto, said liner being adapted for placing in a hole in the ground for receiving concrete thereabout;

ledge means formed in at least one set of walls in said liner;

first and second groove means at least partially formed in the other set of said walls in said liner, said first groove means having a depth at least twice the depth of said second groove means;

lockbolt receiving means at least partially formed in a wall intermediate said other set of walls;

separate door means for closing said opening, said door means including at least a first and second opposing edge portions having a thickness sufficient for being received within said groove means and having a first dimension in the direction between said groove means generally equal to the distance between the innermost ends of said groove means plus a distance generally equal to the depth of said first groove means, and a second dimension orthogonal to said first dimension generally equal to the spacing between the walls in that direction, said door means being inserted by positioning at an angle with said first edge thereof on said ledge means and then sliding said edge into said first groove means while pivoting said second edge thereof toward said ledge means; and lock means on said door means including a lockbolt actuable from a first unlocked position into a second locked position in engagement with said lockbolt receiving means only with said door means in abutting relation with the bottom of said second groove means.

8. The combination according to claim 7 wherein said ledge means further include reinforcing means in the form of metal bars in engagement therewith on the exterior of said liner.

9. The combination according to claim 8 wherein said groove means further include reinforcing means in the form of metal bars in engagement therewith on the exterior of said liner.

10. The combination according to claim 9 wherein said metal bars are elongate steel bars of generally rectangular cross-section adpated, dimensioned and positioned for embedding in the concrete upon pouring.

11. The combination according to claim 10 wherein said lockbolt receiving means includes a notch formed in said wall and a mating notch formed in an aligned one of said bar members.

12. The combination according to claim 7 wherein said first and second groove means extend outwardly from the walls of said liner.

13. The combination according to claim 7 wherein said first and second groove means are formed by portions of said other set of said walls by portions of said liner extending inwardly of said liner.

14. In a door closure arrangement for a safe having opposing sidewalls and opposing end walls defining a chamber having an opening for receiving valuables therein, the combination comprising:

a separable door member configured to close said opening and having at least the first and second opposite edge thereof of generally uniform thickness;

ledge means formed in opposing walls of at least one of said sidewalls and said end walls, said ledge means being positioned and configured for abutting relation with the periphery of said door member in its closed position;

first and second opposing groove means of a width slightly greater than the thickness of said opposite edges of said door member formed in opposing walls of at least one of said sidewalls and said end walls, said first groove means having a depth at least twice as great as said second groove means, said door means being inserted by positioning at an angle with said first edge thereof in engagement with said ledge means and then sliding said first edge into said first groove means while pivoting said second edge toward said ledge means;

lockbolt receiving means on one of said sidewalls and said end walls intermediate the opposing walls including said groove means and generally central relative thereto; and lock means on said door means including a lockbolt actuable along a line generally parallel to the opposing walls including said first and second groove means, said lockbolt being actuable between a first unlocked position and a second locked position in engagement with said lockbolt receiving means only with said door means in abutting relation with the bottom of said second groove means.

15. The combination according to claim 14 wherein said lockbolt receiving means is a notch configured for receiving the free end of said lockbolt therein, and said door means are provided with reinforcing means at a position on each side of said lockbolt in its locked position whereby to preclude forces from forcible entry from being transmitted to said lock means.

16. The combination according to claim 15 wherein said lockbolt receiving means includes a notch in a metal bar in fixed relation to said wall means.

17. The combination according to claim 14 wherein said lockbolt operates in a direction transverse to the direction of insertion of said door member thereby greatly to increase the strength of said door closure arrangement due to shear.

18. In a safe apparatus, the combination comprising:

wall means defining a generally rectangular chamber for receiving valuables therein through an access opening thereof;

ledge means on said wall means extending partially into said chamber;

lockbolt receiving means on one of said wall means generally centrally relative thereto;

first and second groove means on oppositely disposed ones of said wall means in transverse relation to said one wall means with said lockbolt receiving means, said first groove means having a depth substantially greater than the depth of said second groove means;

separate door means for closing said opening, said door means including at least a first and second opposing edge portions having a thickness sufficient for being received within said groove means and having a first dimension in the direction between said groove means generally equal to the distance between the innermost ends of said groove means plus a distance generally equal to the depth of said first groove means, and a second dimension orthogonal to said first dimension generally equal to the spacing between the wall means in that direction, said door means being inserted by positioning at an angle with said first edge thereof on said ledge means and then sliding said edge into said first groove means while pivoting sasid second edge thereof toward said ledge means; and lock means on said door means including a lockbolt actuable along a line generally parallel to the opposing walls including said first and second groove means, said lockbolt being actuable from a first unlocked position into a second locked position in engagement with said lockbolt receiving means only with said door means in abutting relation with of said second groove means.

19. The combination according to claim 18 wherein said said first groove means has a depth at least one and one-half times the depth of said second groove means.

20. The combination according to claim 18 wherein said said first groove means has a depth at least twice the depth of said second groove means.

21. The combination according to claim 18 wherein said lockbolt receiving means includes a notch in a metal bar in fixed relation to said wall means.

22. The combination according to claim 18 wherein said lockbolt operates in a direction transverse to the direction of insertion of said door member thereby greatly to increase the strength of said door closure arrangement due to shear.

23. A method of closing a valuables safe, which comprises:

providing first and second grooves in opposed sidewall portions of a safe body at the mouth thereof, and providing a bolt-receiving opening in a third sidewall portion of said body, providing a safe door having first and second edge portions remote from each other, and having a lockbolt adapted to mate with said opening and adapted to shift in a direction transverse to an imaginary line that extends between said edge portions and is generally perpendicular to both, said transverse direction being generally parallel to the plane of said door.

tilting said door and inserting said first edge portion a predetermined distance into said first groove, moving said door until said second edge portion is registered with said seocnd groove, and then shifting said second edge portion into said second groove a distance less than said predetermined distance, said movement and said shifting being such that said first edge portion does not come out of said first groove, and sliding said bolt into said opening therefor to prevent movement of said door through any distance sufficient to permit either of said edge portions from coming out of its associated groove, said bolt being in shear when any attempt is made to move said door to cause either edge to come out of its groove.

24. A high-strength sliding-door safe, which comprises:

wall means defining a high-strength valuables chamber, and defining access-opening means communicating with said valuables chamber for introducing valuables therein and withdrawing valuables therefrom, a high-strength safe door having first and second edge remote from each other, lock means mounted on said door and having a lock-bolt adapted to shift in a predetermined direction in response to operation of a bolt-actuating mechanism, said lock means being so oriented on said door that said predetermined direction is transverse to an imaginary line that extends between said edges and is generally perpendicular to both, means to define a first groove adapted to receive said first edge, said first groove being sufficiently wide that said first edge may be inserted therein when said door is in tilted relationship about an axis generally parallel to said first edge, said first groove being on a first side of said access-opening means, means to define a second groove adapted to receive said second edge, said second groove being on a second side of said access-opening means, said second side being remote from and opposite said first side, said first and second grooves being sufficiently deep that said first edge may be inserted into said first groove sufficiently far that, after said door is slid in the opposite direction so that said second edge enters said second groove and penetrates therein sufficiently far to be in high-strength relationship relative to the outer wall of said second groove, said first edge will remain in said first groove sufficiently far that said first edge will be in high-strength relationship to the outer wall of said first groove, said position being the closed-safe positions, means, fixedly associated with said wall means, to receive said bolt when said bolt is caused to move in said predetermined direction and be in extended condition, in response to operation of said bolt-accutating mechanism, said last-named means being so sized and located that is receives said bolt when said door is in said closed-safe position, and said bolt therefore being caused to be stressed in shear when an intruder attempts to slide said door further into said first groove.

* * * * *

UNITED STATES PATENT AND TRADEMARK OFFICE

CERTIFICATE OF CORRECTION

PATENT NO. : 4,712,490

DATED : December 15, 1987

INVENTOR(S) : Robert J. Lichter

It is certified that error appears in the above-identified patent and that said Letters Patent is hereby corrected as shown below:

Column 4, line 34, please delete "therough" and substitute therefor ---through---.

Column 5, line 5, please delete the comma after the word "groove".

Column 5, line 8, please delete "34" and substitute therefor ---32---.

Column 5, line 49, please delete "force" and substitute therefor ---forces---.

Column 6, lines 16 and 17, please delete "postioned" and substitute therefor ---positioned---.

Column 6, line 44, please delete "grove" and substitute therefor ---groove---.

Column 6, line 61, please delete "consisitent" and substitute therefor ---consistent---.

Column 12, line 15, please delete "positions" and substitute therefor ---position---.

Column 12, line 20, please delete "accutating" and substitute therefor ---actuating---.

Signed and Sealed this

Fourteenth Day of February, 1989

*Attest:*

DONALD J. QUIGG

*Attesting Officer*

*Commissioner of Patents and Trademarks*